United States Patent [19]

Ohmatsu et al.

[11] 4,040,829

[45] Aug. 9, 1977

[54] MULTILAYER MULTICOLOR PHOTOGRAPHIC MATERIALS

[75] Inventors: Hideki Ohmatsu; Hirozo Ueda, both of Minami-ashigara, Japan

[73] Assignee: Fuji Photo Film Co., Ltd., Minami-ashigara, Japan

[21] Appl. No.: 583,816

[22] Filed: June 4, 1975

[30] Foreign Application Priority Data

June 4, 1974 Japan ..... 49-63082

[51] Int. Cl.[2] ..... G03C 7/04; G03C 3/00

[52] U.S. Cl. ..... 96/6; 96/74

[58] Field of Search ..... 96/74, 7, 6

[56] References Cited

U.S. PATENT DOCUMENTS

| | | | |
|---|---|---|---|
| 2,166,049 | 7/1939 | Gaspar | 96/74 |
| 2,220,187 | 11/1940 | Wilmanns et al. | 96/74 |
| 2,386,167 | 10/1945 | Murray | 96/74 |

*Primary Examiner*—David Klein
*Assistant Examiner*—Louis Falasco
*Attorney, Agent, or Firm*—Sughrue, Rothwell, Mion, Zinn and Macpeak

[57] ABSTRACT

An incorporated-dye image forming coupler type multilayer multicolor photographic material comprising a support having thereon at least two silver halide emulsion layers each of which is sensitive to a different spectral wavelength range, with the silver halide emulsion layer which first receives light at image exposure being positioned so that the light is received through a non-sensitive hydrophilic layer containing a semidiffusible color coupler which forms a dye image having a substantially complimentary color to the sensitive wavelength range of the silver halide emulsion layer first receiving light at image exposure and which has a diffusion coefficient of from about 0.25 to 0.80 as defined by the relationship $$\text{diffusion coefficient} = D_B/D_A$$

wherein $D_A$ is the color density formed by the color coupler where the color coupler is present in the same layer as silver halide particles, developed without imagewise exposure, and $D_B$ is the color density obtained with the color coupler incorporated in a layer which does not contain silver halide particles on a layer which contains silver halide particles, developed without imagewise exposure, the components thereof. amounts thereof and production conditions thereof being the same and the development conditions thereof being the same and with the layers being adjusted using a hardening agent so that the coefficient of expansion of the layers in water at a pH of 7.0 and 25° C does not exceed 400%.

10 Claims, 3 Drawing Figures

MULTILAYER MULTICOLOR PHOTOGRAPHIC MATERIALS

BACKGROUND OF THE INVENTION

1. Field of the Invention

The present invention relates to multilayer multicolor photographic materials and particularly to incorporated-dye image forming coupler type multilayer multicolor photographic materials having improved image sharpness.

2. Description of the Prior Art

Incorporated-dye image forming coupler type multilayer multicolor photographic materials generally have three silver halide emulsion layers each having a different sensitivity range which form dye images corresponding to blue, green and red light on a support. In the silver halide emulsion layers, a large number of silver halide crystals having a particle size nearly corresponding to the wavelength of visible light is randomly dispersed in a binder such as gelatin. Therefore, even if visible light passes perpendicularly into the emulsion layers, the light is scattered by silver halide particles and spreads out in the direction of the plane of the emulsion layers. This phenomenon causes a blurring of the images formed. This is an important problem from the standpoint of image reproduction since the sharpness of dye images formed on the photographic material is deteriorated. This becomes more important where the images are enlarged for observation. Therefore, many attempts have made hitherto for the purpose of improving the sharpness of images.

One attempt is to position a green-sensitive silver halide emulsion layer for forming a magenta dye image as the photosensitive layer nearest the surface. This is because the human eye is the most sensitive to differences in brightness modulated by the magenta image. This attempt, however, causes an undesirable result in that light to be recorded only by a blue-sensitive silver halide emulsion layer is recorded by the green-sensitive layer as the top layer, because silver halide is inherently sensitive to blue light.

Further, a method is known which comprises using colored materials such as a dye in order to absorb scattered rays. However, this method has the defect that the sensitivity is deteriorated.

Another attempt is a method which comprises reducing the thickness of the photographic emulsion layers. For example, a method of decreasing the ratio of the binder to the silver halide is known. However, a substantial decrease of the binder in the emulsion results in a deterioration of the quality of the film to result in a restriction of the quantity of the dye image forming coupler which can be incorporated. This is particularly a defect where the dye image forming coupler is introduced into the silver halide emulsion layer together with a solvent having a high boiling point.

Accordingly, it has been desired to provide a new process for improving the sharpness of images in incorporated-dye image forming coupler type multilayer multicolor photographic materials.

SUMMARY OF THE INVENTION

An object of the present invention is to provide new incorporated-dye image forming coupler type multilayer multicolor photographic materials having improved image sharpness.

According to the present invention, the image sharpness of the incorporated-dye image forming coupler type multilayer multicolor photographic materials can be improved by the manner which is quite different from the conventional manner.

Namely, the fundamental idea of the present invention is that a dye image forming coupler and silver halide are incorporated respectively in different layers and the thickness of the silver halide emulsion layer is reduced so as to prevent a spread of scattered light.

The incorporated-dye image forming coupler type multilayer multicolor photographic material of the present invention comprises a support having thereon silver halide emulsion layers each having a sensitivity to a different spectral wavelength range, wherein the silver halide emulsion layer which initially receives light on image exposure is disposed so as to receive the light through a non-sensitive hydrophilic layer containing a semi-diffusible dye image forming coupler as defined hereinafter.

BRIEF DESCRIPTION OF THE DRAWINGS

FIG. 1 shows a sample wherein a dye image forming coupler and silver halide particles are incorporated in the same layer 11. FIG. 2 shows a sample which has a silver halide emulsion layer 21 and a dye image forming coupler containing layer 22.

DETAILED DESCRIPTION OF THE INVENTION

Usually, a dye image forming coupler for the incorporated-coupler type color photographic materials is a non-diffusible coupler. Herein, the term "non-diffusible coupler" means that the coupler does not substantially diffuse in an organic colloid layer in the presence of an alkaline processing solution. On the other hand, a dye image forming coupler used for the method which comprises forming a dye image in the photographic material by development with a developer containing a dye image forming coupler is a "diffusible coupler", which can freely diffuse in the organic colloid layer of the photographic material in the presence of the alkaline processing solution. Generally speaking, the "semi-diffusible dye image forming coupler" used in the present invention has diffusibility characteristics which are between those of the above-described non-diffusible coupler and those of the above-described diffusible coupler.

The "semi-diffusible dye image forming coupler" used in the present invention means a coupler which satisfies the following conditions that the color density of the sample wherein the coupler and silver halide particles are included in different layers from each other ranges from about 25 to 80% based on that of a sample wherein the coupler and silver halide particles are included in the same layer as a mixture (where the coating amounts of the coupler and the silver halide in both samples are the same as each other), when developed under the same conditions and determined according to the following testing method for determining diffusibility. Hereinafter, such a coupler as used in the present invention is called a "semi-diffusible coupler".

The testing method for determining the diffusibility of the dye image forming couplers in the present invention is illustrated in the following.

A sample wherein a dye image forming coupler and silver halide particles are included in the same layer (Sample A) and a sample which has a multilayer structure comprising a layer which contains only the silver halide particles and a layer thereon which contains only the dye image forming coupler (Sample B) are prepared. In Sample A and Sample B, the same dye image forming coupler dispersion and the same silver halide emulsion are used and the coating amounts of the dye image forming coupler and the silver halide per unit area are adjusted so as they are equal to each other.

Figure 1:
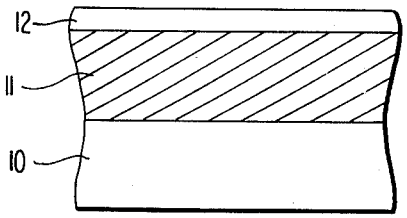
FIG. 1 and FIG. 2 are each a cross-sectional view of a model of samples used for determining diffusibility of the dye image forming couplers.
Figure 2:
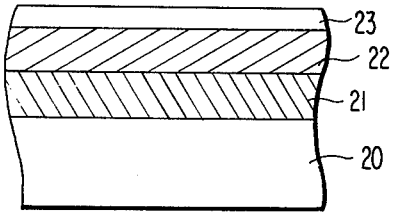

In the following, each sample is illustrated with reference to drawings. Sample A which is shown in FIG. 1 as a model has a gelatin-silver halide emulsion layer 11 which contains a dye image forming coupler on a support 10 and a gelatin surface layer 12 thereon. On the other hand, Sample B which is shown in FIG. 2 as a cross-sectional view of a model has a gelatin-silver halide emulsion layer 21 on a support 20, a gelatin layer 22 which contains a dye image forming coupler, and a gelatin surface layer 23 thereon. In FIG. 1, the support 10 is composed of a conventional photographic support such as a cellulose triacetate film, and layer 11 is that prepared by coating a mixture composed of a coupler dispersion prepared by a conventional method using a coupler to be evaluated (for example, the method described in the following examples) and a gelatin-silver halide photographic emulsion. In the layer 11, it is preferred that the amount of silver coated is 20 mg or so per 100 $cm^2$, the molar ratio of the silver halide to the dye image forming coupler is adjusted so that it is in the range of 3:1 to 6:1, and the thickness of the layer is up to 5 microns. Layer 12 is a surface protective layer composed of gelatin, which has a thickness of about 2 microns. In FIG. 2, the support 20 is the same as the support 10 in FIG. 1. Layer 21 is that prepared by applying the same gelatin-silver halide photographic emulsion as that used for layer 11 in FIG. 1, and the amount of silver applied is adjusted so that it is the same as that of layer 11. Layer 22 on layer 21 is that prepared by applying a mixture of the same coupler dispersion as that used for layer 11 in FIG. 1 and an aqueous gelatin solution so that the thickness is about 3 microns. The amount of the dye image forming coupler in layer 22 is adjusted so that it equals that in layer 11 in FIG. 1. Layer 23 is the same as layer 12 in FIG. 1. Further, a conventional hardening agent is added to each layer shown in FIGS. 1 and 2 in order to prevent excess swelling at development. The amount of the hardening agent is adjusted so the coefficient of expansion of the gelatin layer in water at a pH of 7.0 and 25° C does not exceed 400%. For example, in using the sodium salt of 2-hydroxy-4,6-dichloro-s-triazine, it is added in the amount of 0.4 to 0.8% by the weight based on gelatin.

The thus-prepared Samples A and B are subjected to development processing described in Example 1 without carrying out image exposure. The color densities of both processed Samples are determined and a ratio of the densities is calculated. Namely, the ratio of the color densities is calculated as follows:

$$\text{Ratio of Color Densities} = D_B/D_A$$

wherein $D_A$ is the color density of Sample A shown in FIG. 1 and $D_B$ is the color density of Sample B shown in FIG. 2.

In theory, the ratio of the color densities ranges from 0 to 1. Where the dye image forming coupler does not diffuse at all, the color density $D_B$ of the Sample B is 0. Accordingly, the ratio of the color densities is 0. On the other hand, where the dye forming coupler completely diffuses, the ratio of the color densities becomes 1, because the color density of the Sample B is equal to that of the Sample A.

With the semi-diffusible coupler used in the present invention, the ratio of the color densities ranges from about 0.25 to 0.80. If this value is below about 0.25, diffusion of the dye image forming coupler becomes insufficient and it is impossible to obtain sufficient color density. In the non-diffusible dye image forming coupler used for conventional incorporated-coupler photographic sensitive materials, this value is at most 0.15 to 0.18 and does not exceed 0.20. Accordingly, this non-diffusible dye image forming coupler is undesired for use in the present invention. On the other hand, if the ratio of the color densities exceeds about 0.80, the dye image forming coupler diffuses into other emulsion layers having a different sensitivity because the coupler is too highly diffusible to form a large amount of dyes having an undesired hue and, consequently, color reproduction of the finished images is remarkably deteriorated. Accordingly, diffusible dye image forming couplers used in conventional color developers are unsuitable for use in the present invention. Of the semi-diffusible couplers used in the present invention, compounds having a ratio of the color densities of 0.35 to 0.60 are particularly useful.

The semi-diffusible coupler used in the present invention has the characteristic that the coupler can diffuse to some extent into adjacent layers during development processing. Any dye image forming coupler can be used if it has the above-specified diffusibility. Namely, it is sufficient to control only the diffusibility of the compounds which are known as dye image forming couplers so that the diffusiblity is in the above-described range. For this purpose, a group having less carbon atoms than that of a hydrophobic group (a so-called ballast group) used in the case of conventional non-diffusible couplers can be introduced into the molecule of the dye image forming coupler. The number of carbon atoms in the group which is preferred can not be set forth unequivocally, because the number of carbon atoms is considerably affected by the number and properties of the hydrophilic groups or the hydrophobic groups in the nucleus of the coupler. For example, in the case of an acylacetamide type yellow image forming coupler, the number of carbon atoms is 6 to 8, if one alkyl group is used as a hydrophobic group. In any case, a preferred semi-diffusible dye image forming coupler can be easily selected by carrying out the above-described testing method for determining the diffusibility.

The hydrophobic group can be introduced into a suitable position of the nucleus of the dye image forming coupler directly or through a suitable linking group similar to the case of ballast groups in conventional non-diffusible dye image forming couplers. Examples of preferred linking groups include an ether linkage, a thioether linkage, an amino linkage, an imino linkage, a carbonyl linkage, a sulfonyl linkage, a carbonamide linkage, a sulfonamide linkage, a carbonimide linkage, a sulfonimide linkage, a carbamoyl linkage, a sulfamoyl linkage, a carboxylic acid ester linkage, a sulfonic acid ester linkage, a ureido linkage, and a thioureido linkage.

As the nucleus of the semi-diffusible coupler, any compound can be used if it can form a dye by coupling with the oxidation product of an aromatic primary amino developing agent. Such dyes include indamine, indophenol, indoaniline and azomethine dyes. All known dye image forming coupler residues can be used for the nucleus of the semi-diffusible coupler. Preferred coupler residues have a phenol structure or an active methylene structure. Couplers having a phenol structure include compounds derived from phenol and α-naphthol. Couplers having an active methylene structure are divided into compounds having an active methylene group in their open chain structure and compounds having an active methylene group in a ring structure. The former open chain type methylene couplers include acylacetonitriles, acylacetamides and 1,3-diketones. The latter cyclic methylene couplers include 1,3-indanediones, pyrimidazolones, 5-pyrazolones, 3-imidazolones and pyrazolobenzimidazoles.

Of these couplers, phenols and α-naphthols are suitable as cyan dye forming couplers, 5-pyrazolones are suitable as magenta dye forming couplers, and acylacetamides are suitable as yellow dye forming couplers.

Acylacetamide type yellow dye image forming couplers include compounds represented by the following formula (I):

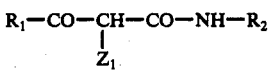

(I)

wherein $R_1$ represents an alkyl group, an aryl group or a heterocyclic group; $R_2$ represents an aryl group; and $Z_1$ represents a hydrogen atom or a coupling releasable group.

The alkyl group represented by $R_1$ may be in the form of a chain (a straight chain and a branched chain) or may be in the form of a ring and may have up to about 8 carbon atoms. Examples of suitable alkyl groups include primary alkyl groups (for example, methyl, propyl, hexyl, and octyl, etc.), secondary alkyl groups linked to a carbonyl group through a secondary carbon atom (for example, isopropyl and isoamyl, etc.), tertiary alkyl groups linked to a carbonyl group through a tertiary carbon atom (for example, tertiary butyl, tertiary amyl and tertiary octyl, etc.) and cyclic alkyl groups (for example, cyclohexyl and norbornyl, etc.). The chain alkyl group can be substituted with an alkoxy group or an aryl group, and the cyclic alkyl group can be substituted with an alkyl group, an alkoxy group, an alkoxyalkyl group or an aryl group with these substituted alkyl groups containing up to about 10 total carbon atoms. Suitable examples of aryl groups represented by $R_1$ include a phenyl group. The aryl (e.g., phenyl) group can be substituted with one or more of a halogen atom (e.g., a chlorine, fluorine, or bromine atom), an alkyl group (e.g., a methyl, butyl, or octyl group), an alkoxy group (e.g., methoxy, ethoxy, or hexyloxy group), an alkoxycarbonyl group (e.g., a methoxycarbonyl, or butoxycarbonyl group), an aryl group (e.g., a phenyl group), an aryloxy group (e.g., a phenoxy group), an aryloxycarbonyl group (e.g., a phenoxycarbonyl group), an acyl group (e.g., an acetyl or butyryl group), a cyano group, a nitro group, an amino group (e.g., a methylamino or a diethylamino group), a carbonamido group (e.g., an acetamido or butyramido group), an imido group (e.g.. a phthalimido group), a sulfonamido group (e.g., an ethylsulfonamido group), a carbamoyl group (e.g., a methylcarbamoyl or butylcarbamoyl group), a sulfamoyl group (e.g., a methylsulfamoyl or ethylsulfamoyl group), a ureido group (e.g., an ethylureido group), a thioureido group (e.g., an ethylthioureido group), a carboxy group and a sulfo group, etc., as substituents. Similar substituents can also be present in the aryl group substituent of the aryl group-substituted alkyl group described above. Suitable heterocyclic groups represented by $R_1$ include 5- and 6-membered rings composed of atoms selected from carbon, oxygen, sulfur, selenium and nitrogen atoms (e.g., a furyl, thiazolyl, oxazoly, imidazolyl, benzofuranyl, benzoxazolyl, benzothiazolyl, benzimidazolyl, quinolinyl, etc., ring). $R_1$ is preferably a tert-butyl group.

Suitable aryl groups represented by $R_2$ are the same as those defined for $R_1$.

The coupling releasable group represented by $Z_1$ is a group from which a dye image forming coupler can be released at coupling with the oxidation product of the aromatic primary amino developing agent. Quite a large number of groups are known as such groups in the art. Examples of such groups include halogen atoms (e.g., a chlorine, fluorine, or iodine atom), a thiocyano group, acyloxy groups (e.g., an acetoxy group), aryloxy groups (e.g., a phenoxy group), arylthio groups (e.g., a phenylthio group), heterocyclicthio groups (e.g., a 1-phenyl-5-tetrazolylthio group), a sulfoxy group (e.g., a methylsulfonyloxy or phenylsulfonyloxy group), groups having an imido structure (e.g., a phthalimido, hydantoinyl or oxazolidinyl group), groups having a saccharin structure, groups having a triazole structure, and arylazo groups (e.g., a phenylazo, 4-hydroxyphenylazo, or naphthylazo group), etc.

5-Pyrazolone type magenta dye image forming couplers include compounds represented by the following formula (II):

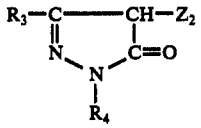

(II)

wherein $R_3$ represents an alkyl group (e.g., having up to about 8 carbon atoms), an aryl group, an alkoxy group (e.g., having up to about 8 carbon atoms), an aryloxy group, a heterocyclic group, an amino group, a carbonamido group, a sulfonamido group or a ureido group; $R_4$ represents an alkyl group, an aryl group or a heterocyclic group; and $Z_2$ represents a hydrogen atom or a coupling releasable group.

Suitable examples of alkyl groups, aryl groups and heterocyclic groups represented by $R_3$ and $R_4$ are the same as those defined for $R_1$. Suitable examples of alkoxy groups are those having up to 8 carbon atoms (e.g., an ethoxy group) and of aryloxy groups are a phenoxy group. Suitable amino groups for $R_3$ include alkylamino groups and arylamino groups (e.g., an amino, methylamino, diethylamino, phenylamino, tolylamino, or chlorophenylamino group). Suitable examples of carbonamido, sulfonamido and ureido groups for $R_3$ are, e.g., ethylcarbonamido, phenylcarbonamido, 3-[-(2,4-di-tert-amylphenoxy)acetamido]-benzamido, thiazolylcarbonamido, benzoxazolylcarbonamido, sulfonamido, butylsulfonamido, phenylsulfonamido, 2-methoxyphenylsulfonamido, imidazolylsulfonamido, ureido, ethylureido, phenylureido, chlorophenylureido, and sulfamoylphenylureido groups.

Suitable coupling releasable groups represented by $Z_2$ are the same as those defined for $Z_1$.

Phenol type and α-naphthol type cyan dye image forming couplers include compounds represented by the following formulae (III) and (IV):

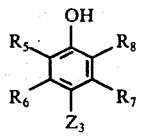
(III)

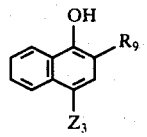
(IV)

wherein $R_5$ represents an alkyl group, an aryl group, a heterocyclic group, an amino group, a carbonamido group, a sulfonamido group, a carbamoyl group or a sulfamoyl group; $R_6$, $R_7$ and $R_8$, which may be the same or different, each represents the groups as defined for $R_5$ and in addition a hydrogen atom, a halogen atom or an alkoxy group; $R_9$ represents a carbamoyl group, a sulfamoyl group, an alkoxycarbonyl group or an aryloxycarbonyl group; and $Z_3$ represents a hydrogen atom or a coupling releasable group.

Suitable alkyl groups, aryl groups and heterocyclic groups represented by $R_5$ to $R_8$ are the same as those defined for $R_1$. Suitable amino groups for $R_5$ to $R_8$ include alkylamino groups and arylamino groups, e.g., as described for $R_3$. Suitable examples of carbamoyl groups for $R_5$ to $R_8$ and $R_9$ are, e.g., ethylcarbamoyl, phenylcarbamoyl, thiazolylcarbamoyl, etc., groups and suitable examples of sulfamoyl groups for $R_5$ to $R_8$ are, e.g., butylsulfamoyl, phenylsulfamoyl, oxazolysulfamoyl, etc., groups. Suitable examples of carbonamido groups and sulfonamido groups for $R_5$ to $R_8$ are defined hereinbefore for $R_3$ and suitable examples of alkoxycarbonyl groups for $R_9$ are, e.g., ethoxycarbonyl, butoxycarbonyl, etc., groups and suitable examples of aryloxycarbonyl groups for $R_9$ are, e.g., phenoxycarbonyl, etc., groups.

Suitable coupling releasable groups represented by $Z_3$ are the same as those defined for $Z_1$.

The number of carbon atoms of the alkyl or aryl groups in the compounds represented by the above-described formulae, where given is merely exemplary and is selected so as to satisfy the above-described diffusibility requirements.

Typical examples of semi-diffusible dye image forming couplers which can be effectively used in the present invention are described in the following. However, the present invention is not to be construed as being limited to these compounds.

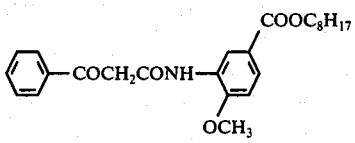
(1)

-continued

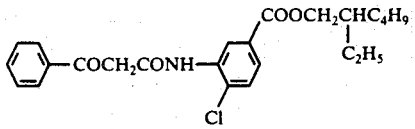
(2)

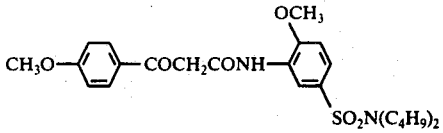
(3)

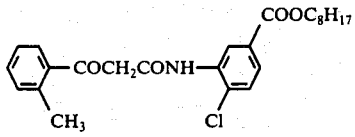
(4)

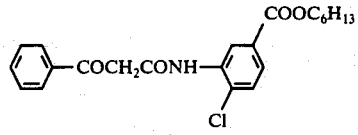
(5)

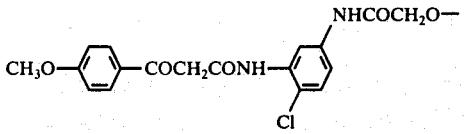
(6)

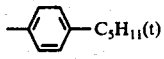

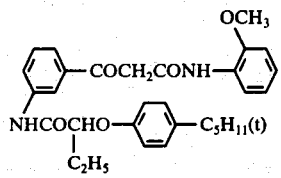
(7)

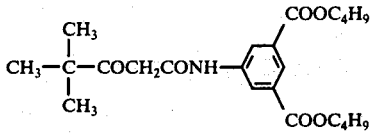
(8)

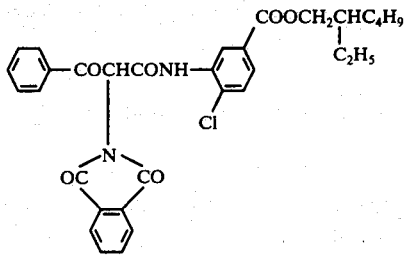
(9)

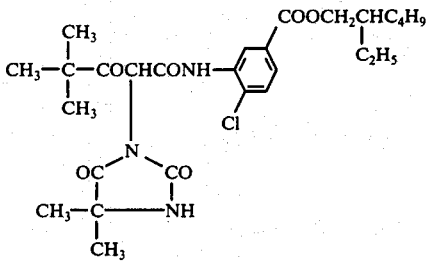
(10)

-continued (11)

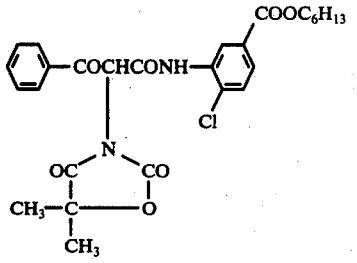

(12)

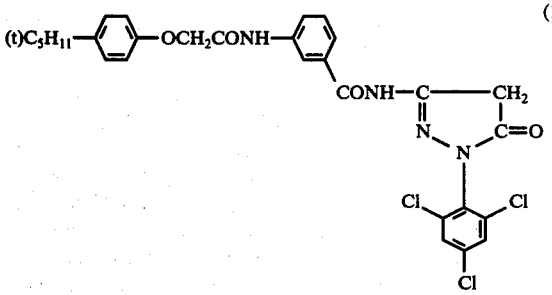

(13)

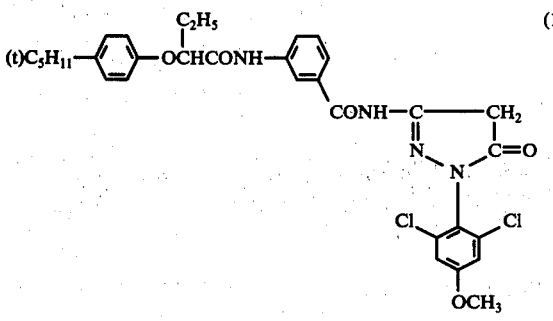

(14)

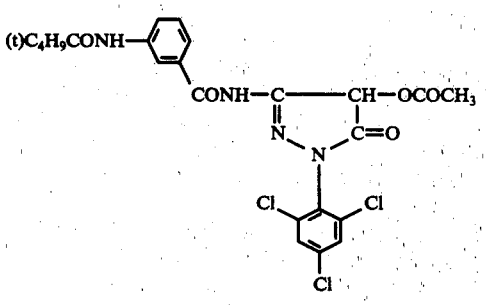

(15)

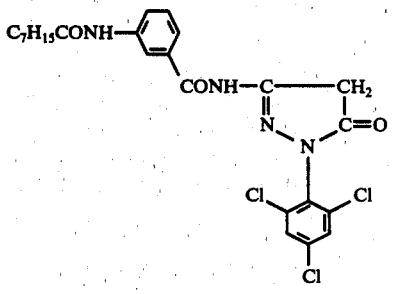

-continued (16)

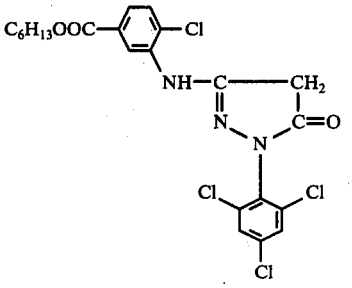

(17)

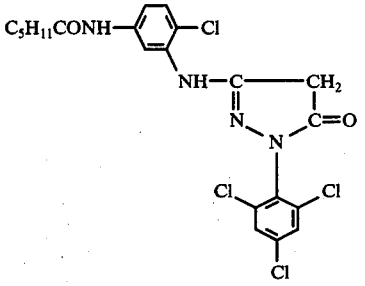

(18)

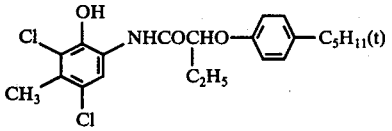

(19)

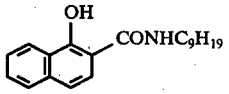

(20)

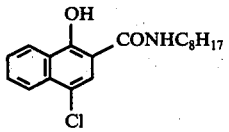

The non-sensitive hydrophilic layer which contains the semi-diffusible dye image forming coupler of the present invention contains a hydrophilic high molecular weight material as a binder. Preferred hydrophilic high molecular materials include compounds used as binders for hydrophilic layers of conventional photographic materials. Examples of hydrophilic high molecular materials include gelatin, gelatin derivatives (for example, modified gelatin prepared by reacting a mono-functional compound with an active site of the gelatin molecule such as an amino group, an imino group, a carboxy group or a hydroxy group, as described in U.S. Pat. Nos. 2,594,293, 2,614,929, 2,763,639, 3,118,766, 3,132,945 and 3,186,846 and British Patents 648,926, 757,806 and 976,391, or grafted gelatin prepared by graft polymerization of a vinyl monomer which is polymerizable with an active site of the gelatin molecule, as described in U.S. Pat. Nos. 2,763,625, 2,831,767 and 2,956,884; *Polymer Letters*, Vol. 5, page 595 (1967); *Phot. Sci. Eng.*, Vol. 9, page 148 (1965) and *J. Polymer Sci.*, Part A-1, Vol 9, page (1971)), albumin, casein, agar-agar, gum arabic, dextran, sodium alginate, starch, hydrophilic cellulose derivatives (for example, carboxymethyl cellulose and hydroxyethyl cellulose), polyvinyl alcohol, polyvinyl pyrrolidone and hydrophilic vinyl polymers (for example, those containing monomer units such as acrylic acid, methacrylic acid, acrylamide, methacrylamide or maleic acid, etc.).

The non-sensitive hydrophilic layer can contain a conventional hardening agent used in the photographic art. Examples of suitable hardening agents include aldehyde compounds such as formaldehyde or glutaraldehyde, ketone compounds such as diacetyl, or cyclopentanedione, reactive halogen containing compounds such as bis-(2-chloroethyl urea) or 2-hydroxy-4,6-dichloro-1,3,5-triazine and those described in U.S. Pat. Nos. 3,288,775 and 2,732,303 and British Patents 974,723 and 1,167,207, reactive olefinic group containing compounds such as divinyl sulfone or 5-acetyl-1,3-diacryloyl -hexahydro-1,3,5-triazine and those described in U.S. Pat. Nos. 3,635,717 and 3,232,763 and British Patent 994,869, N-methylol compounds such as N-hydroxymethylphthalimide and those described in U.S. Pat. Nos. 2,732,316 and 2,586,168, isocyanates as described in U.S. Pat. No. 3,103,437, aziridine compounds described in U.S. Pat. Nos. 3,017,280 and 2,983,611, acid derivatives described in U.S. Pat. Nos. 2,725,294 and 2,725,295, carbodiimide compounds described in U.S. Pat. No. 3,100,704, epoxy compounds described in U.S. Pat. No. 3,091,537, isoxazole compounds described in U.S. Pat. Nos. 3,321,313 and 3,543,292, halocarboxyaldehydes such as mucochloric acid, dioxane derivatives such as dihydroxydioxane or dichlorodioxane, etc., and inorganic hardening agents such as chromium alum or zirconium sulfate, etc. Further, hardener precursor type compounds such as alkali metal bisulfite-aldehyde addition products, hydantoin-methylol derivatives or primary aliphatic nitroalcohols, etc., can be used instead of the above-described compounds.

The non-sensitive hydrophilic layer can contain, if desired, other conventional photographic additives. The thickness of the non-sensitive hydrophilic layer is generally up to about 10 microns, e.g., about 0.5 micron to about 10 microns, and preferably about 1 to 4 microns.

The semi-diffusible dye image forming coupler in the present invention can be introduced into the non-sensitive hydrophilic layer using conventional methods. Particularly, methods which comprise introducing conventional non-diffusible dye image forming couplers into silver halide photographic emulsions (for example, the method described in U.S. Pat. Nos. 2,304,939, 2,322,027, 2,801,170, 2,801,171, 2,949,360, 3,253,921 and 3,574,627, etc.) can be effectively utilized. The amount of the semi-diffusible coupler can be varied greatly according to the desired color density or the characteristics of the coupler. A preferred amount ranges from about 0.05 to 0.5 mols per mol of silver halide included in a silver halide emulsion (the semi-diffusible coupler is converted into a dye image corresponding to the latent image formed in this emulsion layer) to which light passing through the non-sensitive hydrophilic layer reaches first.

As embodiment of the incorporated dye image forming coupler type multilayer multicolor photographic materials of the present invention comprises a support, a silver halide emulsion layer which is sensitive to a first wavelength region in the visible spectrum, a silver halide emulsion layer which is sensitive to a second wavelength range of the visible spectrum and a silver halide emulsion layer which is sensitive to a third wavelength region of the visible spectrum, wherein the silver halide emulsion layer which receives first the light at image exposure is positioned that it receives the light through a non-sensitive hydrophilic layer containing a semi-diffusible coupler which can form a dye image having a substantially complementary color to the sensitive range of the emulsion layer.

Figure 3:
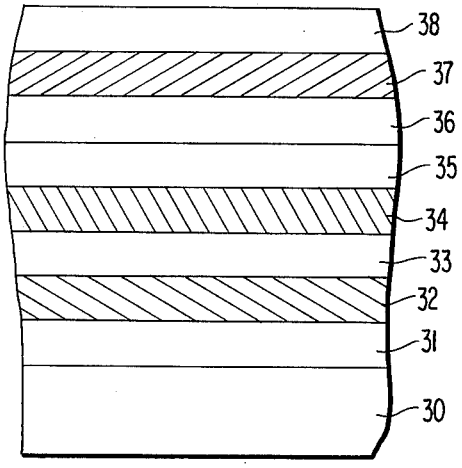
FIG. 3 shows a cross-sectional view of a model of a photographic sensitive material of the present invention which has a blue-sensitive silver halide emulsion layer 36 and a semi-diffusible yellow dye image forming coupler containing layer 37.

An example of the incorporated-dye image forming coupler type multilayer multicolor photographic materials of the present invention is illustrated with reference to the drawings. FIG. 3 shows a cross sectional plan of a typical embodiment of the present photographic material, wherein an antihalation layer 31 is coated on a support 30. A red-sensitive silver halide emulsion layer 32 is coated on layer 31. This layer 32 contains a non-diffusible coupler for forming a cyan dye image together with silver halide particles for recording red light. An intermediate layer 33 is coated on layer 32. A green-sensitive silver halide emulsion layer 34 is coated on layer 33. This layer 34 contains a non-diffusible coupler for forming a magenta dye image together with silver halide particles for recording green light. A yellow filter layer 35 is coated on layer 34. A blue-sensitive silver halide emulsion layer 36 is coated on layer 35. This layer 36 contains silver halide particles for recording blue light. A coupler containing non-sensitive hydrophilic layer 37 is coated on layer 36. This layer 37 contains a semi-diffusible coupler for forming a yellow dye image. A surface protective layer 38 is coated on layer 37. In such photographic materials, it is possible to decrease the spread of scattered light caused by silver halide particles, because the thickness of the blue-sensitive silver halide layer 36 is thin because it does not contain the yellow dye forming coupler. Consequently, the sharpness of the dye images formed in the light-recording layers positioned below the blue-sensitive silver halide emulsion layer, namely the green-sensitive layer 34 and the red-sensitive layer 32, is improved. In this case, the sharpness of the yellow image formed is equal to or superior to that in the case of using the prior art known blue-sensitive silver halide emulsion layer which contains a non-diffusible yellow dye image forming coupler. The blue-sensitive silver halide emulsion layer 36 can contain a non-diffusible yellow dye image forming coupler in an amount so the image sharpness is not damaged.

In FIG. 3, the sharpness of the cyan dye image can be further improved if the red-sensitive silver halide emulsion layer 32 is divided into a silver halide emulsion layer 32A for recording red light and a semi-diffusible coupler containing layer 32B for forming a cyan dye image, and the layer 32B and the layer 32A are coated in turn on the antihalation layer 31.

In the photographic material shown in FIG. 3, the silver halide emulsion layer which first receives the light at image exposure is a layer for recording blue light. However, it can be a layer for recording green light or can be a layer for recording red light. If desired, it can be a layer for recording ultraviolet light or infrared light. The disposition of the light recording layers can be appropriately changed. Further, each light recording layer can comprise two, three or more layers.

In the incorporated-dye image forming coupler type multilayer multicolor photographic materials of the present invention, any element used in conventional color photographic sensitive materials other than the semi-diffusible couplers can be used. Further, the photographic materials of the present invention can be produced by utilizing techniques used for producing the conventional color photographic materials.

The silver halide photographic emulsions used in the present invention are each a dispersion of a photosensitive silver halide such as silver chloride, silver bromide, silver chlorobromide, silver iodochloride, silver iodobromide or silver iodobromochloride in a hydrophilic high molecular weight material, which can be produced by various methods. The crystal form of the silver halide grains used is not limited. Further, the grain size of the silver halide grains is not limited. However, a grain size ranging from about 0.1 to 3 $\mu$ is preferred in general.

As the hydrophilic high molecular weight material included in the photographic emulsion, materials used for the above-described non-sensitive hydrophilic layer can be used. Although the ratio of the silver halide grains and the hydrophilic high molecular weight material as the binder is not limited, it is preferred that the hydrophilic high molecular weight material is used in an amount of about 0.2 to 4 times based on the weight of the silver halide. The silver halide photographic emulsions can contain many additives used for conventional silver halide color photographic emulsions such as chemical sensitizing agents, stabilizing agents, antifogging agents, hardening agents, spectral sensitizing dyes and surface active agents, etc.

As chemical sensitizing agents, gold compounds such as chloroaurate, or gold trichloride as described in U.S. Pat. Nos. 2,399,083, 2,540,085, 2,597,856 and 2,597,915, salts of noble metals such as platinum, palladium, iridium, rhodium or ruthenium, as described in U.S. Pat. Nos. 2,448,060, 2,540,086, 2,566,245, 2,566,263 and 2,598,079, sulfur compounds which form silver sulfide by reacting with silver salts as described in U.S. Pat. Nos. 1,574,944, 2,410,689, 3,189,458 and 3,501,313, and reducing agents such as stannous salts, amines and the like as described in U.S. Pat. Nos. 2,487,850, 2,518,698, 2,521,925, 2,521,926, 2,694,637, 2,983,610 and 3,201,254 can be used.

As stabilizing agents or antifogging agents, numerous compounds such as heterocyclic compounds, mercury containing compounds, mercapto compounds and metal salts, etc., including 4-hydroxy-6-methyl-1,3,3a,7-tetrazaindene and 1-phenyl-5-mercaptotetrazole, can be used. Examples of preferred compounds are described in not only C.E.K. Mees and T. H. James, *The Theory of the Photographic Process,* 3rd Ed., Macmillan & Co., New York (1966) but also U.S. Pat. Nos. 1,758,576, 2,110,178, 2,131,038, 2,173,628, 2,697,040, 2,304,962, 2,324,123, 2,394,198, 2,444,605 ~ 8, 2,566,245, 2,694,716, 2,697,099, 2,708,162, 2,728,663 ~ 5, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339 and British Patents 893,482, 403,789, 1,173,609 and 1,200,188.

Suitable hardening agents are those used for the above-described non-sensitive hydrophilic layer.

As the spectral sensitizing dyes, cyanine dyes such as cyanine, merocyanine and carbocyanine dyes can be used individually or as a combination thereof. These cyanine dyes can be also used together with styryl dyes. Suitable dyes are described in, for example, U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Patents 1,195,302, 1,242,588 and 1,293,862, German Patent Applications (OLS) 2,030,326 and 2,121,780, Japanese Patent Publications 4,936/1968, 14,030/1969 and 10,733/1968, U.S. Pat. Nos. 3,511,664, 3,522,052, 3,527,641, 3,615,613, 3,615,632, 3,617,295, 3,635,721 and 3,694,217 and British Patents 1,137,580 and 1,216,203. These dyes can be suitably selected according to a wavelength range to be sensitized, the sensitivity, and a purpose or use of the photosensitive material.

Surface active agents can be used alone or as a mixture thereof. Although they are used generally as coating assistants, they can be used sometimes for other purposes, for example, for emulsification, sensitization, improvement of photographic properties, prevention of static charge build up, or prevention of adhesion, etc. These surface active agents can be classified as natural surface active agents such as saponin, nonionic surface active agents such as alkylene oxide type, glycerin type or glycidol type surface active agents, cationic surface active agents such as higher alkylamines, quaternary ammonium salts, pyridine and other heterocyclic materials, phosphonium or sulfonium compounds, etc., anionic surface active agents containing an acid group such as a carboxylic acid, sulfonic acid, sulfuric acid, sulfuric acid ester or phosphoric acid ester group, and ampholytic surface active agents such as aminoacids, aminosulfonic acids or aminoalcohol esters of sulfuric acid or phosphoric acid.

Some examples of surface active agents which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,443,654, 3,475,174, 3,545,974 and 3,666,478, German Patent Application (OLS) 1,942,665, British Patents 1,077,317 and 1,198,450, Ryohei Oda et al., *Kaimenkasseizai no Gosei to sono Oyo,* Maki-shoten, (1964), A. W. Schwartz et al., *Surface Active Agents,* Interscience Publications Incorporated, (1958), and J. P. Sisley, *Encyclopedia of Surface Active Agents,* Vol. 2, Chemical Publishing Company, (1964).

The photographic emulsions can contain non-diffusible dye image forming couplers. As such couplers, quite a large number of materials are known in the photographic field and can be effectively used in the present invention. Preferred nondiffusible dye image forming couplers include 4-equivalent or 2-equivalent open chain type methylene yellow couplers, for example, the compounds described in U.S. Pat. Nos. 3,277,155, 3,415,652, 3,447,928, 3,408,194, 2,875,057, 3,265,506, 3,409,439, 3,551,155, 3,551,156, and 3,582,322, and Japanese Patent Applications (OPI) 26,133/1972, 66,834/1973, 66,835/1973, 66,836/1973; 4-equivalent or 2-equivalent pyrazolone type magenta couplers or imidazolone type magenta couplers, for example, compounds described in U.S. Pat. Nos. 2,600,788, 2,983,608, 3,006,759, 3,062,653, 3,214,437, 3,253,924, 3,311,476, 3,419,391, 3,419,808, 3,476,560 and 3,582,322, Japanese Patent Publication 20,636/1972 and Japanese Patent Application (OPI) 26,133/1972; and 2-equivalent or 4-equivalent $\alpha$-naphthol type cyan couplers or phenol type cyan couplers, for example, the compounds described in U.S. Pat. Nos. 2,474,293, 2,698,794, 3,034,892, 3,214,437, 3,253,924, 3,311,476, 3,458,315, 3,582,322 and 3,591,383 and Japanese Patent Publications 11,304/1967 and 32,461/1969. In addition, the DIR couplers described in U.S. Pat. Nos. 3,227,554, 3,297,445, 3,253,924, 3,311,476, 3,397,529, 3,516,831, 3,617,291 and 3,705,801 and German Patent Application (OLS) 2,163,811 can be used.

The 2-equivalent couplers have an advantage that the silver halide content in the photosensitive layer can be decreased, because the amount of silver required to form 1 mol of the dye is less.

The photographic emulsions are applied to substantially planar materials which do not undergo any substantial dimensional change during processings, for example, rigid supports such as glass, metal or ceramics, and flexible supports. Examples of typical flexible supports include cellulose nitrate films, cellulose acetate films, cellulose acetate butyrate films, cellulose acetate propionate films, polystyrene films, polyethylene terephthalate films, polycarbonate films and laminated films thereof, thin glass films, and paper, etc. Baryta paper, coated or laminated paper prepared by coating or laminating polymers of α-olefins having 2 to 10 carbon atoms such as polyethylene, polypropylene or ethylene-butene copolymers, and synthetic resin films having a matted surface which have improved adhesive property to other high molecular weight materials and excellent printability as described in Japanese Patent Publication 19,068/1972 provide excellent results as well.

These supports can be transparent or can be opaque. As transparent supports, not only colorless transparent supports but also colored transparent supports prepared by adding dyes or pigments to the support can be used. These have been used hitherto for X-ray films and are described in *J. SMPTE, Vol.* 67, page 296 (1958). Opaque supports include not only intrinsically opaque supports but also supports prepared by adding dyes or pigments such as titanium oxide to transparent films, synthetic resin films whose surface was processed by the method described in Japanese Patent Publication 19,068/1972, and light-shielding paper or synthetic resin films which contain carbon black or dyes, etc. When the adhesive strength between the support and the photographic emulsion layer is insufficient, a subbing layer which is adhesive to both of the emulsion layer and the support can be employed. Further, the surface of the support can be subjected to a corona discharge, an ultraviolet light application or a flame treatment, etc., in order to further improve the adhesive properties.

The layers which compose the photographic sensitive material can be coated using various methods such as a dip coating method, an air-knife coating method, a curtain coating method or an extrusion coating method using the hopper described in U.S. Pat. No. 2,681,294. If desired, two or more layers can be coated at the same time using the method described in U.S. Pat. Nos. 2,761,791, 3,508,947, 2,941,898 and 3,526,528. A suitable silver halide coating amount per layer generally ranges from about 20 to 100 mg (as silver) per 100 $cm^2$ of the support.

In the incorporated-dye image forming coupler type multilayer multicolor photographic materials of the present invention, after exposure thereof, dye images can be produced by color development using aromatic primary amine compounds such as p-phenylenediamine derivatives. Examples of typical developing agents include N-N-diethyl-p-phenylenediamine, 2-amino-5-diethylaminotoluene, 2-amino-5-(N-ethyl-N-laurylamino)-toluene, 4-(N-ethyl-N-(β-hydroxyethyl)amino)aniline, 3-methyl-4-amino-N-ethyl-N-(β-hydroxyethyl)aniline and the inorganic acid salts thereof, 4-amino-3-methyl-N-ethyl-N-(β-methanesulfonylamidoethylaniline sesquisulfate monohydrate described in U.S. Pat. No. 2,193,015, N-(2-amino-5-diethylaminophenylethyl)methanesulfonamide sulfate described in U.S. Pat. No. 2,592,364, N,N-dimethyl-p-phenylenediamine hydrochloride, and 3-methyl-4-amino-N-ethyl-N-methoxyethylaniline described in Japanese Patent Application (OPI) 64,933/1973. Details of these color developing agents are described in L. F. A. Mason, *Photographic Processing Chemistry*, pages 226 ~ 229, Focal Press, London, (1966). Further, it is possible to use these agents together with 3-pyrazolidones.

Various additives can be added to a color developer as the occasion demands. For example, alkali agents (for example, alkali metal or ammonium hydroxides, carbonates or phosphates, etc.). pH controlling agents or buffer agents (for example, weak acids such as acetic acid or boric acid, weak bases, or the salts thereof), development accelerators (for example, pyridinium compounds or cationic compounds described in U.S. Pat. No. 2,648,604 and 3,671,247, potassium nitrate or sodium nitrate, polyethylene glycol condensation products or derivatives thereof described in U.S. Pat. Nos. 2,533,990, 2,577,127 and 2,950,970, nonionic compounds such as polythioethers represented by the compounds described in British Patents 1,020,033 and 1,020,032, polymer compounds having a sulfite ester group such as the compounds described in U.S. Pat. No. 3,068,097, pyridine, ethanolamines, organic amines, benzyl alcohol and hydrazines, etc.), antifogging agents (for example, alkali bromides, alkali iodides, nitrobenzimidazoles described in U.S. Pat. Nos. 2,496,940 and 2,656,271, mercaptobenzimidazole, 5-methylbenzotriazole, 1-phenyl-5-mercaptotetrazole, compounds for rapid processing solutions as described in U.S. Pat. Nos. 3,113,864, 3,342,596, 3,295,976, 3,615,522 and 3,597,199, thiosulfonyl compounds described in British Patent 972,211, phenazine-N-oxides described in Japanese Patent Publication 41,675/1971, and controlling agents described in *Kagakushashin Binrin, Vol.* 2, pages 29 ~ 47), stain or sludge preventing agents described in U.S. Pat. No. 3,161,513 and 3,161,514 and British Patents 1,030,442, 1,144,481 and 1,251,558, interlayer effect accelerators described in U.S. Pat. No. 3,536,487, and preservatives (for example, sulfites, acid sulfites, hydroxylamine hydrochloride, formsulfite, and alkanolamine-sulfite addition products) can be employed.

A black-and-white development processing can be carried out prior to color development. As developing agents for such a black-and-white development, 4-aminophenols such as 4-N-methylaminophenol hemisulfate, 4-N-benzylaminophenol hydrochloride and 4-N,N-diethylaminophenol sulfate, etc., 3-pyrazolidones such as 1-phenyl-3-pyrazolidone, 4,4-dimethyl-1-phenyl-3-pyrazolidone and 4-methyl-1-phenyl-3-pyrazolidone, polyhydroxybenzenes such as hydroquinone, 2-methylhydroquinone, 2-phenylhydroquinone, 2-chlorohydroquinone, pyrogallol and catechol, etc., p-phenylenediamines such as p-phenylenediamine hydrochloride, and N,N-diethyl-p-phenylenediamine sulfate, etc., ascorbic acid, N-(p-hydroxyphenyl)glycine, and compounds described as developing agents in *The Theory of the Photographic Process*, C. E. K. Mees & T. H. James, 3rd Ed., Chapter 13, MacMillan & Co., New York (1966) and L. F. A. Mason, *Photographic Processing Chemistry, pages* 16~30, Oxford Press, (1966), can be employed. These compounds can be used individually or as a suitable combination thereof.

In the multilayer multicolor photographic material of the present invention, the images can be formed by methods which comprise processing in the presence of oxidizing agents. Such methods include a method of using peroxides as described in U.S. Pat. Nos. 3,674,490 and 3,684,511 and a method of using cobalt complex compounds as described in German Patent Application (OLS) 2,226,770 and 2,226,771.

In the photographic materials of the present invention, other known methods for improving the image sharpness can be used in combination with the present invention.

The incorporated-dye image forming coupler type multilayer multicolor photographic materials of the present invention are excellent because good image sharpness is obtained. Particularly, the present invention is effective with a photographic material wherein an oil solvent having a high boiling point or a high molecular weight material is necessary for introducing the dye image forming coupler into the photographic material. Further, the photographic materials of the present invention can be easily processed, because it is not necessary to add the dye image forming coupler to a color developer, and thus excellent color photographic images can be easily obtained.

The photographic materials of the present invention are useful as photographic materials for photography, projection or duplication, for example, as a color negative film, a color reversal film, a color positive film, a color printing paper or a color duplicating film, etc. Particularly, they are suitable where enlarged films or enlarged prints are to be obtained.

The present invention will be illustrated in the following in greater detail. Unless otherwise indicated herein, all parts, percents, ratios and the like are by weight.

EXAMPLE 1

A mixture of 100 g of 1-hydroxy-N-dodecyl-2-naphthamide, 100 g of dibutyl phthalate and 200 ml of ethyl acetate was heated to 55° C to dissolve, and the resulting solution was mixed with 1 kg of a 10% aqueous gelatin solution to which 120 ml of a 5% aqueous solution of sodium dodecyl sulfate was added. The mixture was dispersed using a homogenizer to prepare a cyan dye image forming coupler dispersion.

To 700 g of a negative type photographic emulsion containing 77 g of silver iodobromide (iodide content: 5 mol %, average grain size: 0.5 micron) and 49 g of gelatin, 300 g of a 5.2% aqueous solution of gelatin was added, and the resulting mixture was kept at 35° C. To this mixture, 80 ml of a 0.5% methanol solution of anhydro-9-ethyl-3,3'-(2-hydroxy-1-sulfopropyl)-naphthiothiacarbocyanine hydroxide, 40 ml of a 0.5 aqueous solution of 4-hydroxy-6-methyl-1,3,3a,7-tetrazaindene, 350 g of the above-described cyan dye image forming coupler dispersion, 10 ml of a 2% aqueous solution of sodium 2-hydroxy-4,6-dichloro-s-triazine and 10 ml of a 4% aqueous solution of saponin were added in turn to prepare a coating solution for a red-sensitive silver halide emulsion layer.

To a cellulose triacetate photographic film support, 1 kg of an aqueous solution containing 10 g of black colloidal silver having an average particle size of 0.1 micron, 0.2 g of sodium 2-hydroxy-4,6-dicloro-s-triazine, 1.75 g of sodium dodecylbenzene sulfonate and 50 g of gelatin was coated to form an antihalation layer (dry film thickness: 2.5 microns). To this layer, the above-described coating solution for the red-sensitive silver halide emulsion layer was coated to form a red-sensitive silver halide emulsion layer (dry film thickness: 3.5 microns). The red-sensitive silver halide emulsion layer contained 0.20 mol of the cyan dye image forming coupler per mole of silver halide. Then an aqueous solution of gelatin was coated to form an intermediate layer (dry film thickness: 1.5 mirons).

A mixture of 150 g of 1-(2,4,6-trichlorophenyl)-3-dodecylamido-5-pyrazolone, 150 g of tricresyl phosphate and 200 ml of ethyl acetate was heated to 55° C to dissolve, and the resulting solution was mixed with 1 kg of a 10% aqueous gelatin solution to which 120 ml of a 5% aqueous solution of sodium dodecyl sulfate was added. The mixture was dispersed using a homogenizer to prepare a magenta dye image forming coupler dispersion.

To 700 g of a negative type photographic emulsion containing 77 g of silver iodobromide (iodide content: 5 mol%, average grain size: 0.55 micron) and 49 g of gelatin, 300 g of a 5.2% aqueous solution of gelatin was added and the mixture was kept at 35° C. To this solution, 100 ml of a 0.1% methanol solution of anhydro-3,3'-disulfopropyl-9-ethyl-5,5'-diphenyloxacarbocyanine hydroxide, 40 ml of a 0.5% aqueous solution of 4-hydroxy-6-methyl-1,3,3a,7-tetrazaindene, 280 g of the above-described magenta dye image forming coupler dispersion, 10 ml of a 2% aqueous solution of sodium 2-hydroxy-4,6-dichloro-s-triazine and 10 ml of a 4% aqueous solution of saponin were added in turn to prepare a coating solution for a green-sensitive silver halide emulsion layer.

This coating solution for the green-sensitive layer was coated on the above-described intermediate layer to form a green-sensitive silver halide emulsion layer (dry film thickness: 4.0 microns). The green-sensitive silver halide emulsion layer contained 0.21 mol of the magenta dye image forming coupler per mol of silver halide. On this layer, 1 kg of an aqueous solution containing 3g of yellow colloidal silver having an average particle size of 0.03 micron, 0.2 g of sodium 2-hydroxy- 4,6-dichloro-s-triazone, 1.75 g of sodium dodecylbenzene sulfonate, 0.8 g of saponin and 50 g of gelatin was coated to form a yellow filter layer (dry film thickness: 1.0 micron).

A mixture composed of 150 g of α-(4-dodecylbenzoyl)-2'-methoxyacetanilide, 200 g of dibutyl phthalate and 150 ml of ethyl acetate was heated to 55° C and the resulting solution was mixed with 1 kg of a 10% aqueous gelatin solution to which 120 g of a 5% aqueous solution of sodium dodecyl sulfate was added. The mixture was dispersed using a homogenizer to prepare a yellow dye image forming coupler dispersion.

150 g of a 5.2% aqueous gelatin solution was added to 850 g of the same silver iodobromide emulsion as that used in the coating solution for the green-sensitive silver halide emulsion layer and the mixture was kept at 35° C. To this mixture 310 g of the above-described yellow dye image forming coupler dispersion, 10 ml of a 2% aqueous solution of sodium 2-hydroxy-4,6-dichloro-s-triazine and 10 ml of a 4% aqueous solution of saponin were added in turn to prepare a coating solution for a blue-sensitive silver halide emulsion layer.

This coating solution for the blue-sensitive silver halide emulsion layer was coated on the above-described yellow filter layer to form a blue-sensitive silver halide emulsion layer (dry film thickness: 4.0 microns). The blue-sensitive silver halide emulsion layer contained 0.20 mol of the yellow dye image forming coupler per mol of silver halide. On this layer, an aqueous solution of gelatin was coated to form a surface protective layer (dry film thickness: 1.5 microns). Thus, a multilayer multicolor photographic material (Sample I) was produced. This is a prior art type of photographic material.

On the other hand, a multilayer multicolor photographic material (Sample II) of the present invention was produced in the same manner as in Sample I but the blue-sensitive silver halide emulsion layer contained the yellow dye image forming coupler in half the amount used in Sample I and a non-sensitive hydrophilic layer containing a semi-diffusible dye image forming coupler of the present invention was coated on the blue-sensitive silver halide emulsion layer and the same surface protective layer was coated subsequently thereon.

The blue-sensitive silver halide emulsion layer of Sample II contained the coupler dispersion in half the amount as compared with the blue-sensitive silver halide emulsion layer of Sample I, namely, 0.01 mol of the yellow dye image forming coupler per mol of silver halide. Further, the dry film thickness was adjusted to 3.0 microns so that the silver content per unit area was the same as that of the blue-sensitive silver halide emulsion layer of Sample I.

A coating solution for the non-sensitive hydrophilic layer containing the semi-diffusible dye image forming coupler was prepared by heating a mixture of 150 g of the semi-diffusible dye image forming coupler (2) of the present invention, 200 g of dibutyl phthalate and 150 ml of ethyl acetate to 55° C, mixing the resulting solution with 1 kg of a 10% aqueous gelatin solution to which 120 ml of a 5% aqueous solution of sodium dodecyl sulfate was added, dispersing the resulting mixture using a homogenizer, mixing 400 g of the resulting semi-diffusible dye image forming coupler dispersion with 1 kg of a 5% aqueous gelatin solution, and adding thereto 10 ml of a 2% aqueous solution of sodium 2-hydroxy-4,6-dichloro-s-triazine and 10 ml of a 4% aqueous solution of saponin.

This solution for the non-sensitive hydrophilic layer was coated on the above-described blue-sensitive silver halide emulsion layer to form a non-sensitive hydrophilic layer (dry film thickness: 2.0 microns) containing the semi-diffusible dye image forming coupler. This layer contained 0.15 mol of the semi-diffusible dye image forming coupler per mol of silver halide in the blue-sensitive silver halide emulsion layer.

A test chart having a sinusoidal wave pattern for evaluating image sharpness (for example, that described in *Scientific Publications of the Fuji Photo Film Co., Ltd.*, No. 15, page 38 (1967)) was closely contacted with Sample I and Sample II. The samples were exposed to light using a light source having a color temperature of 4800° K and subjected to the following development processing.

| Processing Step | Temperature (° C) | Time (minute) |
|---|---|---|
| Black-and-White Development | 24 | 10 |
| Stopping | " | 1.5 |
| Water Washing | " | 3 |
| Reversal Exposure | " | 1 |
| Color Development | " | 15 |
| Stopping | " | 1.5 |
| Water Washing | " | 3 |
| Bleaching | " | 6 |
| Fixing | " | 4 |
| Water Washing | " | 4 |

The compositions of each processing solution were as follows.

| Black-and-White Developer: | | |
|---|---|---|
| Sodium Bisulfite (anhydrous) | 8 | g |
| 1-Phenyl-3-pyrazolidone | 0.35 | g |
| Sodium Sulfite (anhydrous) | 37 | g |
| Hydroquinone | 5.5 | g |
| Sodium Carbonate (anhydrous) | 28.2 | g |

-continued

| | | |
|---|---|---|
| Sodium Thiocyanate (50% aqueous solution) | 2.1 | ml |
| Sodium Bromide | 1.3 | g |
| Potassium Iodide (0.1% aqueous solution) | 13 | ml |
| Water to make | 1 | l |
| | (pH: 9.9 ± 0.1) | |
| Stopping Solution: | | |
| Glacial Acetic Acid | 30 | ml |
| Sodium Hydroxide | 1.65 | g |
| Water to make | 1 | l |
| | (pH: 3.5 ± 0.2) | |
| Color Developer: | | |
| Benzyl Alcohol | 4.5 | ml |
| Sodium Sulfite (anhydrous) | 7.5 | g |
| Sodium Tertiary Phosphate (dodecahydrate) | 36 | g |
| Sodium Bromide | 0.9 | g |
| Potassium Iodide (0.1% aqueous soltuion) | 90 | ml |
| Sodium Hydroxide | 3.25 | g |
| Citrazinic Acid | 3.25 | g |
| p-Amino-N-ethyl-N-(β-methanesulfonamido-ethyl)-m-toluidine Sulfate | 10.5 | g |
| Water to make | 1 | l |
| | (pH: 11.65 ± 0.10) | |
| Bleaching Solution: | | |
| Sodium Bromide (anhydrous) | 43 g | |
| Potassium Ferricyanide (anhydrous) | 165 g | |
| Borax (pentahydrate) | 1 g | |
| Sulfuric Acid or Sodium Hydroxide | to adjust pH to 8.70 ± 0.15 | |
| Water to make | 1 l | |
| Fixing Solution | | |
| Sodium Thiosulfate (pentahydrate) | 200 g | |
| Sodium Sulfite (anhydrous) | 10 g | |
| Sodium Secondary Phosphate (anhydrous) | 15 g | |
| Water to make | 1 l | |
| | (pH: 8.2 ± 0.3) | |

The space frequency response characteristics of the blue-sensitive, green-sensitive and red-sensitive silver halide emulsion layers of each sample were determined. The results obtained are shown in Table 1.

TABLE 1

| Silver Halide Emulsion Layer | | Space Frequency Response (%) 10/mm | 20/mm | 30/mm | 40/mm |
|---|---|---|---|---|---|
| Blue-Sensitive Layer | | | | | |
| | Sample I | 100 | 56 | 32 | 21 |
| | Sample II | 100 | 58 | 37 | 22 |
| Green-Sensitive Layer | | | | | |
| | Sample I | 95 | 48 | 24 | 16 |
| | Sample II | 95 | 52 | 31 | 21 |
| Red-Sensitive Layer | | | | | |
| | Sample I | 95 | 47 | 22 | 12 |
| | Sample II | 95 | 48 | 28 | 18 |

It can be seen from the results in Table 1 that the green-sensitive silver halide emulsion layer and the red-sensitive silver halide emulsion layer of Sample II which is the multilayer multicolor photographic material of the present invention exhibit a notably excellent frequency response in the high frequency range of above 20/mm as compared with Sample I which is the prior photographic material. This means that image sharpness is improved according to the present invention as a result of the decrease of the light scattering in the blue-sensitive silver halide emulsion layer.

In order to compare the photographic properties of Sample I and Sample II, each sample was exposed to light using a conventional method through a wedge employing a light source having a color temperature of 4800° K and the above-described development processing was carried out. The results obtained are shown in Table 2.

TABLE 2

| Sample | Speed* Red-Sensitive Layer | Green-Sensitive Layer | Blue-Sensitive Layer | Maximum Blue Density |
|---|---|---|---|---|
| I | 100 | 100 | 100 | 3.00 |
| II | 98 | 100 | 95 | 3.05 |

*Relative value based on Sample I being 100.

It can be understood from the results in Table 2 that Sample II according to the present invention has nearly the same sensitivity as that of Sample I and that the maximum color density of the yellow dye image is sufficiently high. Some increase in the blue density in the green-sensitive silver halide emulsion layer due to diffusion of the semi-diffusible dye image forming coupler (2) was observed in Sample II.

As is clear from the above-described results, the image sharpness can be remarkably improved in the multilayer multicolor photographic materials of the present invention while the other photographic properties remain constant.

EXAMPLE 2

A mixture of 100 g of 1-(2,4,6-trichlorophenyl)-3-{3-[(2,4-di-tert-amylphenoxy)acetamido]benzamido}-5-pyrazolone, 150 g of dibutyl phthalate and 100 ml of ethyl acetate was heated to 60° C to dissolve, and the resulting solution was mixed with 1 kg of a 5% aqueous gelatin solution to which 80 ml of a 5% aqueous solution of sodium dodecylbenzene sulfonate was added. The mixture was dispersed using a mixer to prepare a magneta dye image forming coupler dispersion (A).

A magenta dye image forming coupler dispersion (B) was prepared in the same manner but 100 g of 1-(2,4,6-trichlorophenyl)-3-{3[(2,4-di-tert-amylphenoxy)acetamido]benzamido}-4-(4-methoxyphenyl)-azo-5-pyrazolone was used.

1 kg of a negative type photographic emulsion containing 80 g of silver iodobromide (iodide content: 6 mol %, average grain size: 0.6 micron) and 120 g of gelatin was kept at 40° C. To this emulsion, 150 ml of a 0.1% methanol solution of anhydro3,3'-disulfopropyl-9-ethyl-5,5'-diphenyl-oxacarbocyanine hydroxide, 40 ml of a 0.5% aqueous solution of 4-hydroxy-6-methyl-1,3,3a,7-tetrazaindene, 340 g of the above-described magneta dye image forming coupler dispersion (A), 110 g of the above-described emulsion (B), 10 ml of a 2% aqueous solution of sodium 2-hydroxy-4,6-dichloro-s-triazine and 10 ml of a 4% aqueous solution of saponin were added in turn to prepare a coating solution for a green-sensitive silver halide emulsion layer.

The same antihalation layer (dry film thickness: 2.5 microns) was coated on the same film supported as in Example 1. On this layer, the coating solution for the green-sensitive silver halide emulsion layer was coated to form a green-sensitive silver halide emulsion layer (dry film thickness: 4.5 microns). This layer contained 0.19 mol of the magenta dye image forming coupler per mol of silver halide. Then the same yellow filter layer as in Example 1 was coated (dry film thickness: 1.0 micron) thereon.

A mixture of 60 g of α-(4-methoxybenzoyl)-2'-chloro-5'-[2-(2,4-di-tert-amylphenoxy)butyramido]acetanilide, 100 g of tricresyl phosphate and 100 ml of ethyl acetate was heated to 60° C to dissolve. The resulting solution was mixed with 1 kg of a 5% aqueous gelatin solution to which 100 ml of a 5% aqueous solution of sodium dodecylbenzene sulfonate was added, and the mixture was dispersed using a mixer to prepare a yellow dye image forming coupler dispersion.

1 kg of a negative type photographic emulsion containing 45 g of silver iodobromide (iodide content: 6 mol %, average grain size: 0.6 micron) and 160 g of gelatin was kept at 40° C. To this emulsion, 40 ml of a 0.5% aqueous solution of 4-hydroxy-6-methyl-1,3,3a,7-tetrazaindene, 500 g of the above-described yellow dye image forming coupler dispersion, 10 ml of a 2% aqueous solution of sodium 2-hydroxy-4,6-dichloro-s-triazine and 10 ml of a 4% aqueous solution of saponin were added in turn to prepare a coating solution for a blue-sensitive silver halide emulsion layer. This coating solution for the blue-sensitive silver halide emulsion layer was coated on the above-described yellow filter layer to form a blue-sensitive silver halide emulsion layer (dry film thickness: 5.0 microns). This layer contained 0.18 mols of the yellow dye image forming coupler per mol of silver halide. On this layer, an aqueous solution of gelatin was coated to form a surface protective layer (dry film thickness: 1.5 microns). Thus, a multilayer multicolor photographic material (Sample III) was prepared. This is a prior art type photographic material.

On the other hand, Sample IV was prepared in the same manner as in Sample III except that the magenta dye image forming coupler dispersion (A) in the coating solution for the green-sensitive silver halide emulsion layer was used in an amount of 300 g, the magenta-dye image forming coupler dispersion (B) in the coating solution for the blue-sensitive silver halide emulsion layer was used in the amount of 150 g, the yellow dye image forming coupler dispersion in the coating solution for the blue-sensitive silver halide emulsion layer was used in an amount of 200 g, the dry film thickness of the blue-sensitive silver halide emulsion layer was adjusted to 3.7 microns (accordingly, the silver content coated per unit area was the same as that of the blue-sensitive silver halide emulsion layer in Sample III), and a coating solution for a non-sensitive hydrophilic layer which was prepared by mixing 550 g of a semidiffusible dye image forming coupler dispersion used in Example 1 with 1 kg of a 5% aqueous gelatin solution and adding 10 ml of a 2% aqueous solution of sodium 2-hydroxy-4,6-dichloro-s-triazine and 10 ml of a 4% aqueous solution of saponin thereto was coated on the blue-sensitive silver halide emulsion layer to form a layer having a dry film thickness of 1.8 microns. In this sample, the green-sensitive silver halide emulsion layer contained 0.19 mol of the magneta dye image forming coupler per mol of silver halide, the blue-sensitive silver halide emulsion layer contained 0.07 mol of the yellow dye image forming coupler per mol of silver halide, and the non-sensitive hydrophilic layer contained 0.19 mol of the semi-diffusible dye image forming coupler per mol of silver halide of the blue-sensitive silver halide emulsion layer.

Samples III and IV were exposed to light the same manner as in Example 1 and space frequency response characteristics were evaluated. The development processing was carried out according to the following steps.

| Procesing Step | Temperature (° C) | Time (minute) |
|---|---|---|
| Color Development | 24 | 8 |
| Stopping | " | 1.5 |
| Fixing | " | 2.5 |
| Water Washing | " | 3 |
| Bleaching | " | 3 |

-continued

| Procesing Step | Temperature (° C) | Time (minute) |
|---|---|---|
| Water Washing | " | 2 |
| Fixing | " | 2.5 |
| Water Washing | " | 4 |

The color developer had the following composition.

| Color Developer | | |
|---|---|---|
| N,N-Diethyl-p-phenylenediamine Sulfate | 4 | g |
| Hydroxylamine Sulfate | 1.2 | g |
| Sodium Sulfite (anhydrous) | 2 | g |
| Potassium Bromide | 2 | g |
| Sodium Carbonate | 75 | g |
| Water to make | 1 | l |

The other processing solutions each had the same composition as in Example 1.

The space frequency response characteristics of the blue-sensitive and green-sensitive silver halide emulsion layers in each sample are shown in Table 3.

TABLE 3

| Silver Halide Emulsion Layer | | Space Frequency Response (%) | | | |
|---|---|---|---|---|---|
| | | 10/mm | 20/mm | 30/mm | 40/mm |
| Blue-Sensitive Layer | | | | | |
| | Sample III | 105 | 85 | 55 | 30 |
| | Sample IV | 105 | 85 | 57 | 32 |
| Green-Sensitive Layer | | | | | |
| | Sample III | 100 | 65 | 39 | 22 |
| | Sample IV | 100 | 67 | 44 | 30 |

It can be understood from the results in Table 3 that the green-sensitive silver halide emulsion layer of Sample IV which is the multilayer multicolor photographic material of the present invention exhibits a markedly excellent frequency response in the high frequency range of above 20/mm as compared with Sample III which is the prior art photographic material.

After only the green-sensitive silver halide emulsion layer of Samples III and IV was selectively exposed to light and the samples were developed, the blue density of the resulting dye image in the green-sensitive silver halide emulsion layer was determined. As the result of this determination, the blue density had a definite value notwithstanding the change of the exposure in each sample. This means the increase of the blue density resulting from diffusion of the semi-diffusible dye image forming coupler (2) in Sample IV was negated by the selfmasking function of the green-sensitive silver halide emulsion layer. Accordingly, if such a color negative film is used, it is possible to obtain color images having improved sharpness without a deterioration of color reproduction characteristics.

While the invention has been described in detail and with reference to specific embodiments thereof, it will be apparent to one skilled in the art that various changes and modifications can be made therein without departing from the spirit and scope thereof.

What is claimed is:

1. An incorporated-dye image forming coupler type multilayer photographic material comprising a support having thereon a silver halide emulsion layer which is sensitive to a first wavelength region of the visible spectrum, a silver halide emulsion layer thereon which is sensitive to a second wavelength region of the visible spectrum and thereon a silver halide emulsion layer which is sensitive to a third wavelength region of the visible spectrum, wherein the silver halide emulsion layer which receives first the light at image exposure is positioned so that said layer first receiving said light receives the light through a non-sensitive hydrophilic layer containing a semi-diffusible coupler which can form a dye image having a substantially complementary color to the sensitive wavelength range of said silver halide emulsion layer first receiving light at image exposure and which has a diffusion coefficient of from about 0.25 to 0.80 as defined by the relationship $$\text{diffusion coefficient} = D_B/D_A$$

wherein $D_A$ is the color density formed by the color coupler where the color coupler is present in the same layer as silver halide particles developed without imagewise exposure, and $D_B$ is the color density obtained with the color coupler incorporated in a layer which does not contain silver halide particles on a layer which contains silver halide particles developed without image-wise exposure, the components thereof, amounts thereof and production conditions thereof being the same and the development conditions thereof being the same and with the layers being adjusted using a hardening agent so that the coefficient of expansion of the layers in water at a pH of 7.0 to 25° C does not exceed 400%.

2. The photographic material of claim 1, wherein said diffusion coefficient ranges from 0.35 to 0.60.

3. The photographic material of claim 1, wherein said silver halide emulsion layer which first receives light is a blue-sensitive silver halide emulsion layer.

4. The photographic material of claim 1, wherein said semi-diffusible color coupler is a phenol coupler, an α-naphthol coupler, an acylacetonitrile coupler an acylacetamide coupler, a 1,3-diketone coupler, a 1,3-indanedione coupler, a pyrimidazolone coupler, a 5-pyrazolone coupler, a 3-imidazolone coupler or a pyrazolobenzimidazole coupler.

5. The photographic material of claim 4, wherein the semi-diffusible color coupler is a phenol coupler, an α-naphthol coupler, a 5-pyrazolone coupler or an acylacetamide coupler.

6. The photographic material of claim 5, wherein said semi-diffusible color couple is a compound selected from the group consisting of color couplers represented by the formula (I):

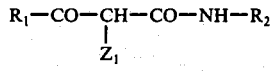

(I)

wherein $R_1$ represents an alkyl group, an aryl group or a heterocyclic group; $R_2$ represents an aryl group; and $Z_1$ represents a hydrogen atom or a coupling releasable group; of the following formula (II):

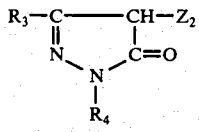

(II)

wherein $R_3$ represents an akyl group, an aryl group, an alkoxy group, an aryloxy group, a heterocyclic group, an amino group, a carbonamido group, a sulfonamido group or a ureido group; $R_4$ represents an alkyl group, an aryl group or a heterocyclic group and $Z_2$ represents a hydrogen atom or a coupling releasable group; or by the following formulas (III) and (IV)

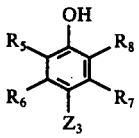
(III)

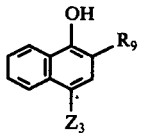
(IV)

wherein $R_5$ represents an alkyl group, an aryl group, a heterocyclic group, an amino group, a carbonamido group, a sulfonaido group, a carbamoyl group or a sulfamoyl group; $R_6$, $R_7$ and $R_8$, which may be the same or different, each represents the groups as defined for $R_5$ and in addition represents a hydrogen atom, a halogen atom or an alkoxy group; $R_9$ represents a carbamoyl group, a sulfamoyl group, an alkoxycarbonyl group or an aryloxycabonyl group; and $Z_3$ represents a hydrogen atom or a coupling releasable group.

7. The photographic material of claim 6, wherein said semi-diffusible color coupler has the general formula (I).

8. The photographic material of claim 6, wherein said semi-diffusible color coupler is:

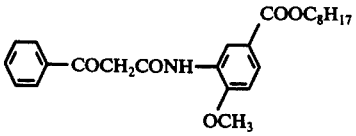

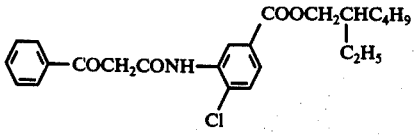

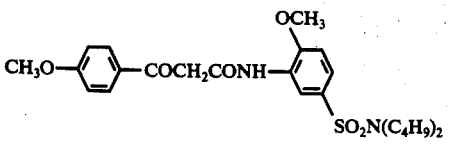

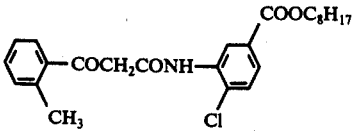

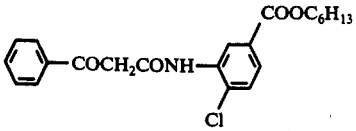

-continued

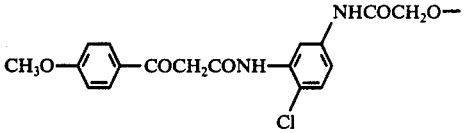

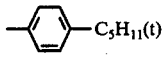

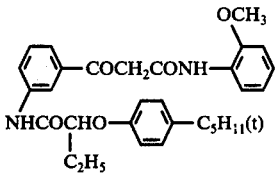

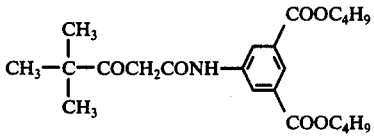

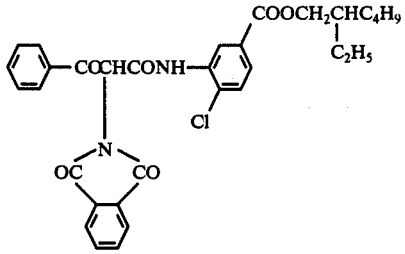

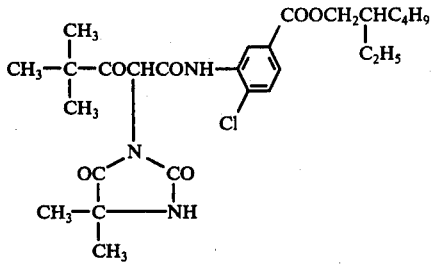

or

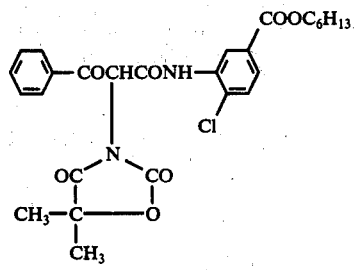

9. The photographic material of claim 1, wherein said non-sensitive hydropholic layer contains said semi-diffusible color coupler in a hydrophilic high molecular weight material as a binder.

10. The photographic material of claim 1, wherein the amount of the semi-diffusible color coupler in the non-sensitive hydrophilic layer ranges from about 0.05 to 0.5 mol per mol of the silver halide in the silver halide emulsion layer for which the semi-diffusible color coupler forms a dye image having a substantially complementary color to the sensitive wavelength range of the silver halide emulsion layer.

* * * * *